US011664154B2

(12) United States Patent
Yang et al.

(10) Patent No.: US 11,664,154 B2
(45) Date of Patent: May 30, 2023

(54) COIL COMPONENT

(71) Applicant: SAMSUNG ELECTRO-MECHANICS CO., LTD., Suwon-si (KR)

(72) Inventors: Ju Hwan Yang, Suwon-si (KR); Seo Eun Kim, Suwon-si (KR); Byung Soo Kang, Suwon-si (KR); Byeong Cheol Moon, Suwon-si (KR); Joung Gul Ryu, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 685 days.

(21) Appl. No.: 16/696,052

(22) Filed: Nov. 26, 2019

(65) Prior Publication Data

US 2021/0057146 A1 Feb. 25, 2021

(30) Foreign Application Priority Data

Aug. 20, 2019 (KR) ..... 10-2019-0101780

(51) Int. Cl.
*H01F 27/29* (2006.01)
*H01F 27/32* (2006.01)

(52) U.S. Cl.
CPC ..... *H01F 27/292* (2013.01); *H01F 27/327* (2013.01)

(58) Field of Classification Search
CPC ..... H01F 27/292; H01F 27/327
See application file for complete search history.

(56) References Cited

U.S. PATENT DOCUMENTS

2013/0222101 A1* 8/2013 Ito ..... H01F 3/08 336/83
2015/0048915 A1* 2/2015 Yoon ..... H01F 17/0013 336/192
2015/0102891 A1* 4/2015 Yoon ..... H01F 27/2804 336/200
2016/0276089 A1* 9/2016 Inoue ..... H01F 17/0033
2017/0169930 A1* 6/2017 Kudo ..... H01F 17/0013
(Continued)

FOREIGN PATENT DOCUMENTS

KR 10-2015-0114924 A 10/2015
KR 10-2018-0028374 A 3/2018
KR 10-2018-0054266 A 5/2018

*Primary Examiner* — Mohamad A Musleh
*Assistant Examiner* — Malcolm Barnes
(74) *Attorney, Agent, or Firm* — Morgan, Lewis & Bockius LLP

(57) ABSTRACT

A coil component includes a support substrate and a coil portion disposed on the support substrate, a body, in which the support substrate and the coil portion are embedded, having one surface and the other surface, one side surface and the other side surface, and one end surface and the other end surface, a first lead-out portion and a second lead-out portion, respectively extending from the coil portion to be exposed from the one side surface and the other side surface, an insulating layer disposed on each of the one surface and the other surface, and an oxide insulating layer disposed on each of the one side surface and the other side surface and each of the one end surface and the other end surface. The insulating layer is provided with a plurality of slits spaced apart from each other to expose a surface of the body.

18 Claims, 13 Drawing Sheets

(56) References Cited

U.S. PATENT DOCUMENTS

| | | | | |
|---|---|---|---|---|
| 2017/0352467 | A1* | 12/2017 | Kakiuchi | H01F 27/29 |
| 2018/0137965 | A1* | 5/2018 | Lee | H01F 17/0033 |
| 2018/0218825 | A1* | 8/2018 | Sato | H01F 41/0233 |
| 2018/0366248 | A1* | 12/2018 | Maruyama | H01G 4/30 |
| 2019/0189338 | A1* | 6/2019 | Kim | H01F 27/2828 |

* cited by examiner

COIL COMPONENT

CROSS-REFERENCE TO RELATED APPLICATION(S)

This application claims the benefit under 35 USC 119 (a) of Korean Patent Application No. 10-2019-0101780 filed on Aug. 20, 2019 in the Korean Intellectual Property Office, the entire disclosure of which is incorporated herein by reference for all purposes.

TECHNICAL FIELD

The present disclosure relates to a coil component.

BACKGROUND

An inductor, a coil component, is a representative passive element used in an electronic device together with a resistor and a capacitor.

A thin film type power inductor is manufactured by forming a coil portion using a plating process, curing a magnetic powder-resin composite, in which magnetic powder particles and a resin are mixed, to form a body, and forming external electrodes on external surface of the body.

However, in the case in which the body is formed using magnetic metal powder particles having high conductivity, plating bleeding may occur on a surface of the body when external electrodes are formed on external surfaces of the body by plating.

Accordingly, there is a need for an effective method of maintaining component characteristics while preventing plating bleeding by forming an insulating layer on a surface of a body.

SUMMARY

An aspect of the present disclosure is to provide a coil component in which plating bleeding may be prevented to improve reliability thereof.

Another aspect of the present disclosure is to provide a coil component in which a decrease in a surface area of a magnetic material of a body may be efficiently prevented.

According to an aspect of the present disclosure, a coil component includes a support substrate and a coil portion disposed on the support substrate, a body, in which the support substrate and the coil portion are embedded, having one surface and the other surface opposing each other, one side surface and the other side surface connecting the one surface and the other surface to each other and opposing each other, and one end surface and the other end surface, opposing each other, each connecting the one side surface and the other side surface to each other, a first lead-out portion and a second lead-out portion, respectively extending from the coil portion to be exposed to the one side surface and the other side surface of the body, an insulating layer disposed on each of the one surface and the other surface of the body, and an oxide insulating layer disposed on each of the one side surface and the other side surface of the body and each of the one end surface and the other end surface of the body. The insulating layer is provided with a plurality of slits spaced apart from each other to expose portions of the one surface and the other surface of the body of the body.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
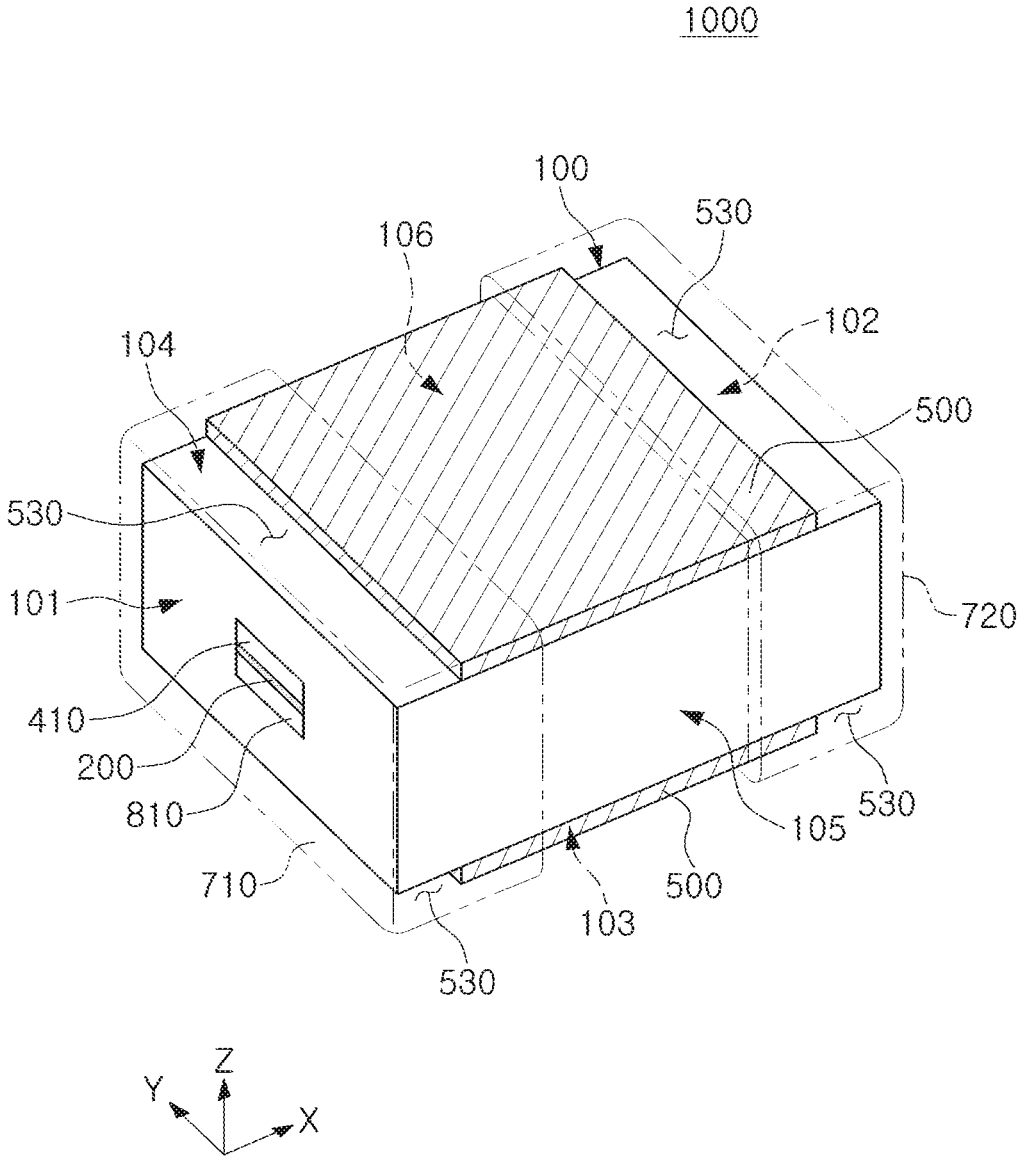
FIGS. 1 and 2 are schematic diagrams of a coil component according to a first embodiment in the present disclosure.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed, as will be apparent to one of ordinary skill in the art, with the exception of operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

Hereinafter, examples of the present disclosure will be described in detail with reference to the accompanying drawings so that those skilled in the art may easily carry out the present disclosure.

In the drawing, the X direction may be defined as a first direction or a length direction, the Y direction as a second direction or a width direction, and the Z direction as a third direction or a thickness direction.

Hereinafter, a coil component according to an embodiment will be described in detail with reference to the accompanying drawings. Referring to the accompanying drawings, the same or corresponding components are denoted by the same reference numerals, and duplicate descriptions thereof will be omitted.

Various types of electronic components are used in electronic devices. Various types of coil components may be suitably used for noise removal or the like between these electronic components.

For example, the coil component in an electronic device may be used as a power inductor, a high frequency (HF) inductor, a general bead, a bead for high frequency (GHz Bead), a common mode filter, or the like.

First Embodiment

Figure 2:
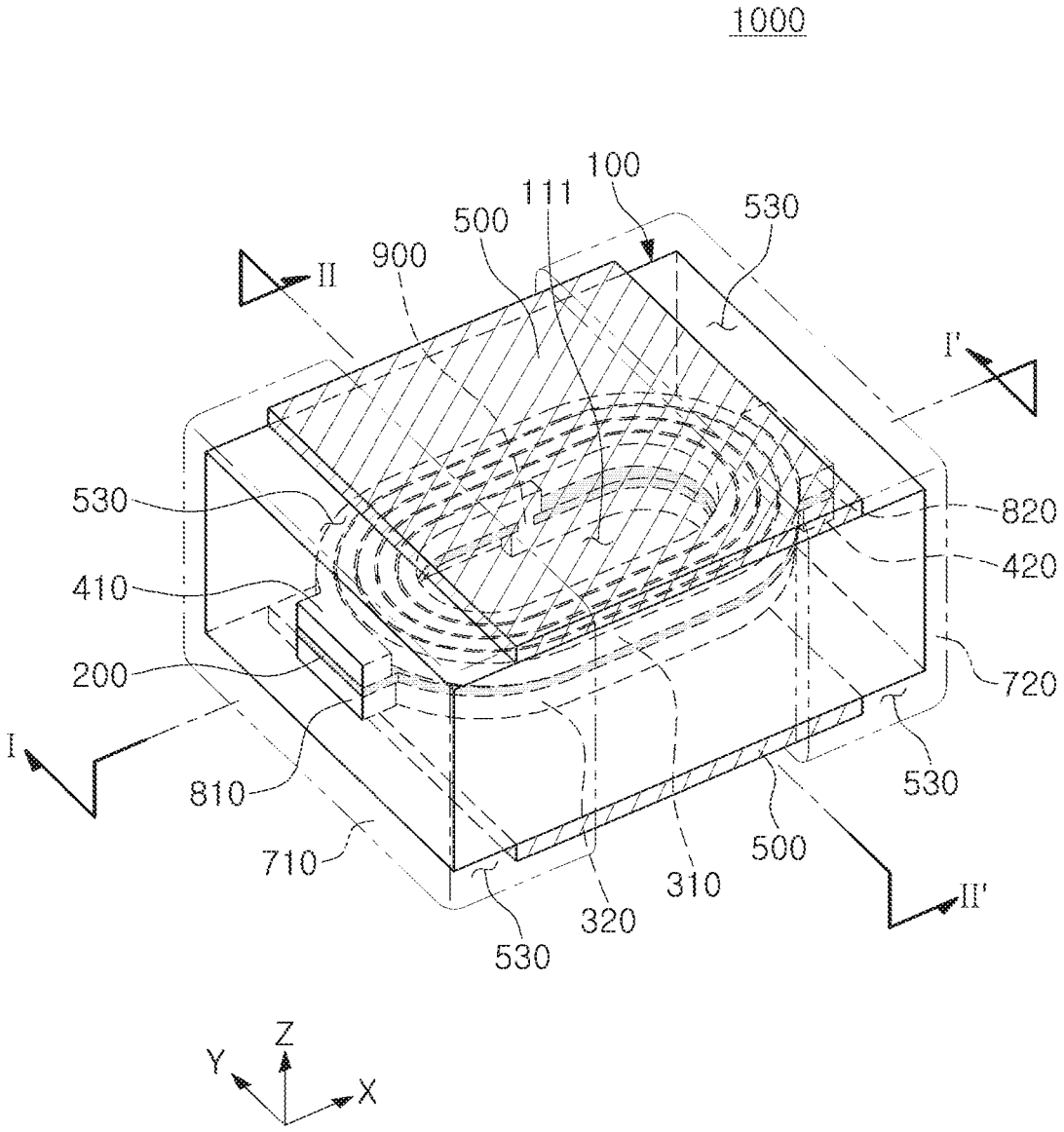
Figure 3:
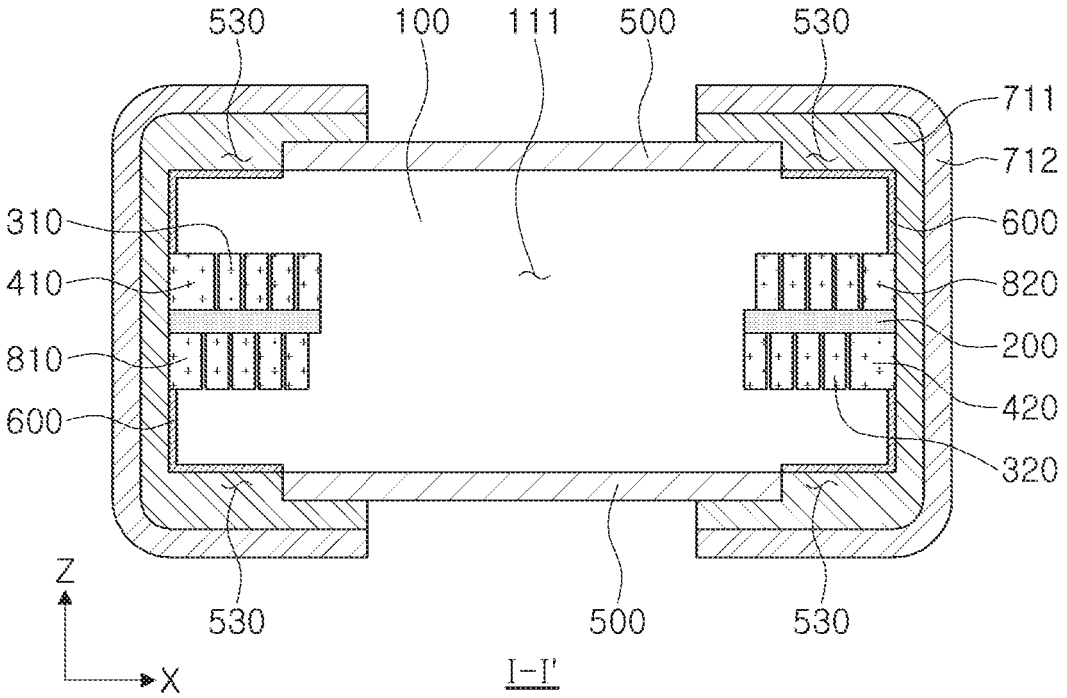
FIG. 3 is a cross-sectional view taken along line I-I' in FIG. 2.
Figure 4:
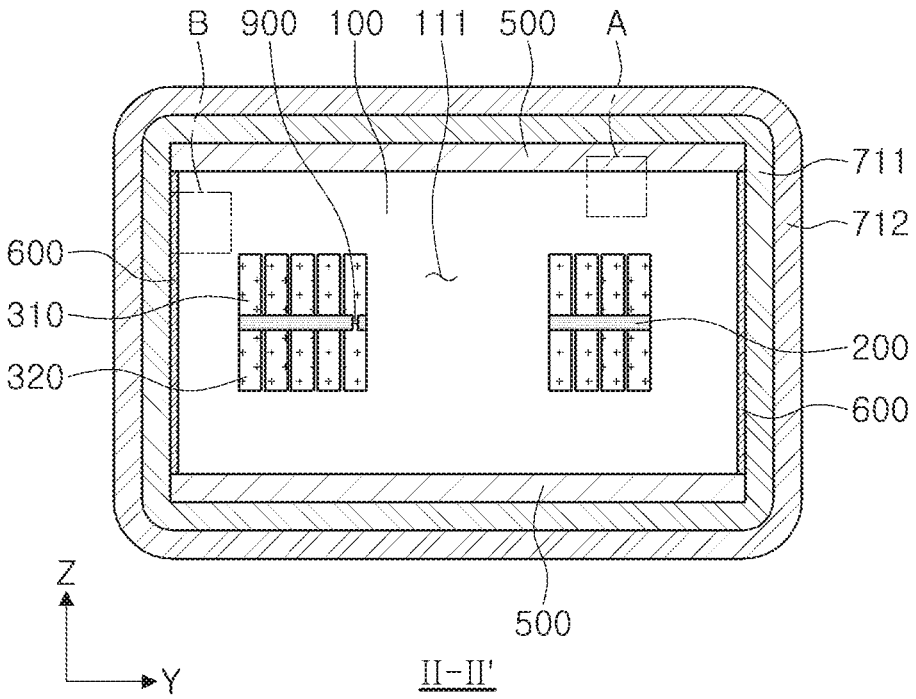
FIG. 4 is a cross-sectional view taken along line II-II' in FIG. 2.
Figure 5:
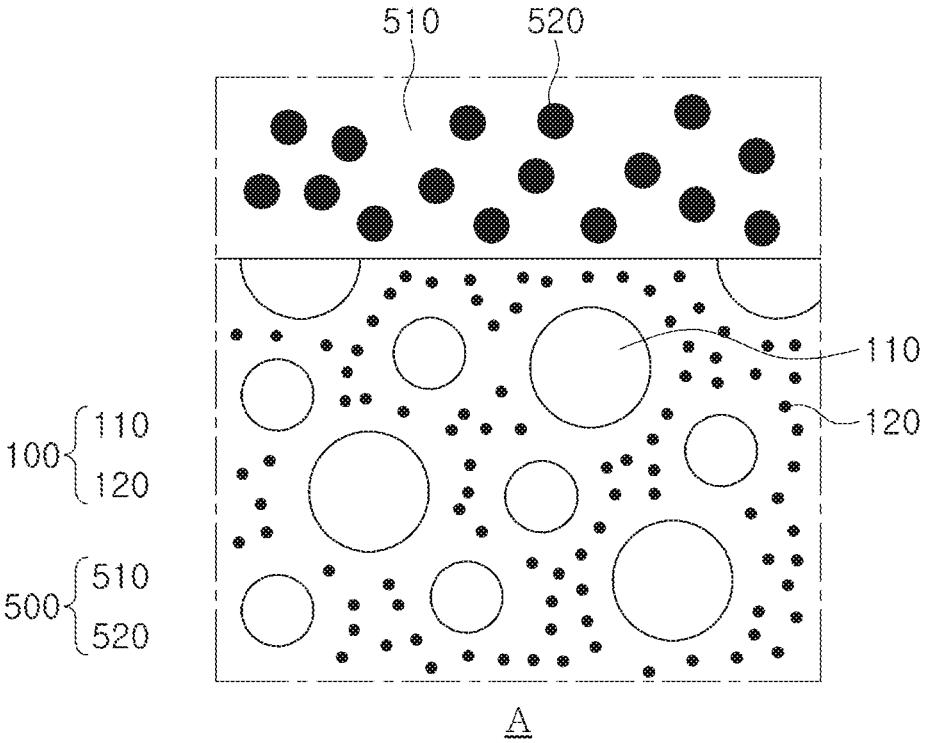
FIG. 5 is an enlarged view of portion 'A' in FIG. 4.
Figure 6:
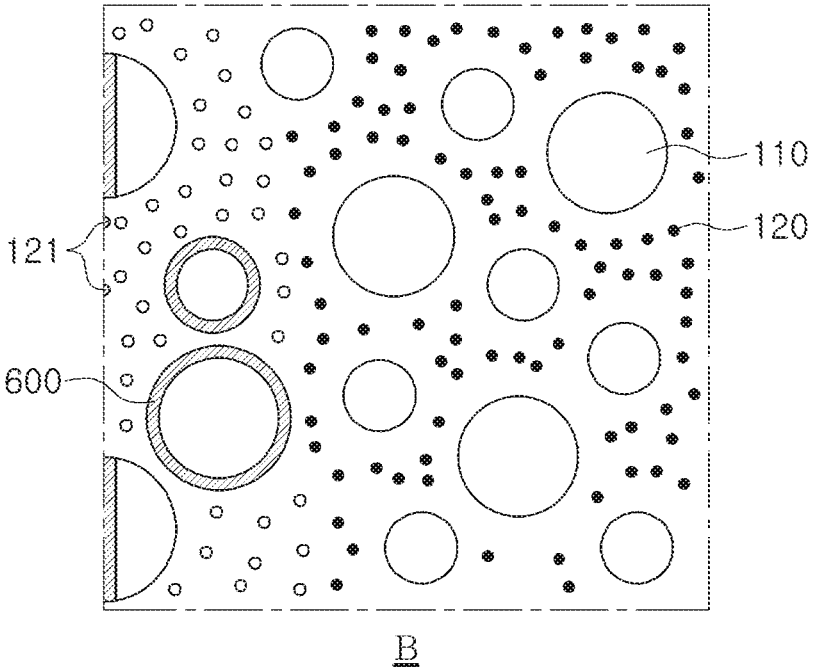
FIG. 6 is an enlarged view of portion 'B' in FIG. 4.

FIGS. 1 and 2 are schematic diagrams of a coil component according to a first embodiment in the present disclosure. FIG. 3 is a cross-sectional view taken along line I-I' in FIG. 2. FIG. 4 is a cross-sectional view taken along line II-II' in FIG. 2. FIG. 5 is an enlarged view of portion 'A' in FIG. 4. FIG. 6 is an enlarged view of portion 'B' in FIG. 4. A body, applied to the coil component according to the first embodiment, is mainly illustrated in FIG. 1, and a coil portion, applied to the coil component according to the first embodiment, is mainly illustrated in FIG. 2.

Referring to FIGS. 1 to 6, a coil component 1000 according to the first embodiment may include a body 100, a support substrate 200, coil portions 310 and 320, lead-out portions 410 and 420, an insulating layer 500, and an oxide insulating layer 600, and may further include external electrodes 710 and 720 and auxiliary lead-out portions 810 and 820.

The body 100 forms the exterior of the coil component 1000 according to an embodiment, and includes coil portions embedded therein.

The body 100 may be formed to have a substantially hexahedral shape, for example.

Referring to FIG. 1, the body 100 has a first surface 101 and a second surface 102 opposing each other in a length direction X, a third surface 103 and a fourth surface 104 opposing each other in a thickness direction Z, and a fifth surface 105 and a sixth surface 106 opposing each other in a width direction Y. Each of the first and second surfaces 101 and 102 of the body 100, opposing each other, connects the third and fourth surfaces 103 and 104 of the body 100 opposing each other. Each of the fifth and sixth surfaces 105 and 106 of the body 100, opposing each other, connects the first and second surfaces 101 and 102 of the body 100 opposing each other. In this embodiment, one surface and the other surface of the body 100 refer to the first surface 101 and the second surface 102, respectively. One end surface and the other end surface of the body 100 refer to the fifth surface 105 and the sixth surface 106 of the body 100, respectively.

As an example, the body 100 may be formed such that the coil component 1000, including the external electrodes 710 and 720 to be described later, has a length of 0.2±0.1 mm, a width of 0.25±0.1 mm, and a maximum thickness of 0.4 mm, but an example thereof is not limited thereto.

The body 100 may include a magnetic material and a resin. More specifically, the body 100 may be formed by laminating one or more magnetic composite sheets including a resin and a magnetic material dispersed in the resin. Alternatively, the body 100 may have a structure other than the structure in which the magnetic material is dispersed in the resin. For example, the body 100 may be formed of a magnetic material such as ferrite.

The magnetic material may be ferrite or magnetic metal powder particles.

The ferrite powder particles may be at least one of spinel type ferrites such as Mg—Zn type, Mn—Zn type, Mn—Mg type, Cu—Zn type, Mg—Mn—Sr type, Ni—Zn type and the like, hexagonal ferrites such as Ba—Zn type, Ba—Mg type, Ba—Ni type, Ba—Co type, Ba—Ni—Co type and the like, garnet type ferrites such as a Y system and the like, and Li-based ferrites.

The magnetic metal powder particles may include at least one selected from the group consisting of iron (Fe), silicon (Si), chromium (Cr), cobalt (Co), molybdenum (Mo), aluminum (Al), niobium (Nb), copper (Cu), and nickel (Ni). For example, the magnetic metal powder particles may be at least one of pure iron powder particles, Fe—Si-based alloy powder particles, Fe—Si—Al based alloy powder particles, Fe—Ni based alloy powder particles, Fe—Ni—Mo based alloy powder particles, Fe—Ni—Mo—Cu based alloy powder particles, Fe—Co based alloy powder particles, Fe—Ni—Co based alloy powder particles, Fe—Cr based alloy powder particles, Fe—Cr—Si based alloy powder particles, Fe—Si—Cu—Nb based alloy powder particles, Fe—Ni—Cr based alloy powder particles, and Fe—Cr—Al based alloy powder particles.

The magnetic metal powder particles may be amorphous or crystalline. For example, the magnetic metal powder particles may be Fe—Si—B—Cr amorphous alloy powder particles, but is not limited thereto.

The ferrite particle and the magnetic metal powder particles may each have an average diameter of about 0.1 μm to 30 μm, but average diameters thereof are not limited thereto.

The body 100 may include two or more types of magnetic materials dispersed in a resin. The phrase "different types of magnetic materials" means that the magnetic materials dispersed in the resin are distinguished from each other by any one of an average diameter, a composition, crystallinity and a shape. Referring to FIGS. 5 and 6, the body 100 may include first metal magnetic powder particles 110 and second metal magnetic powder particles 120, each having a particle diameter smaller than a particle diameter of each of the first metal magnetic powder particles 110. In this embodiment, the first magnetic metal powder particles 110 may be coarse powder including a compound containing iron (Fe) and niobium (Nb), and the second magnetic metal powder particles 120 may be fine particles including a compound containing iron (Fe).

The resin may include, but is not limited to, an epoxy, polyimide, a liquid crystal polymer, or the like, alone or in combination.

The support substrate 200 is disposed inside the body 100 and has both surfaces on which the first and second coil portions 310 and 320 are disposed, respectively. The support substrate 200 has a thickness of 10 μm or more and 60 μm or less.

The support substrate 200 may be formed of an insulating material including a thermosetting insulating resin such as an epoxy resin, a thermoplastic insulating resin such as polyimide or a photoimageable dielectric resin, or may be formed of an insulating material in which this insulating resin is impregnated with a reinforcing material such as a glass fiber or an inorganic filler. For example, the insulating substrates 251 and 252 may be formed of an insulating material such as prepreg, Ajinomoto Build-up Film (ABF), FR-4, bismaleimide triazine (BT) resin, and a Photo Imageable Dielectric (PID) resin, or the like, but a material thereof is not limited thereto.

The inorganic filler may be one or more selected from the group consisting of silica ($SiO_2$), alumina ($Al_2O_3$), silicon carbide (SiC), barium sulphate ($BaSO_4$), talc, mud, mica powder, aluminum hydroxide ($AlOH_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$) and calcium zirconate ($CaZrO_3$).

When the support substrate 200 is formed of an insulating material including a reinforcing material, the support substrate 200 may provide further improved rigidity. When the support substrate 200 is formed of an insulating material, not including a glass fiber, the support substrate 200 may be advantageous for thinning of the entire coil portions 310 and 320. When the support substrate 200 is formed of an insulating material including a photoimageable dielectric resin, the number of processes for forming the coil portions 310 and 320 may be decreased, which is advantageous for reduction in manufacturing costs and formation of fine vias.

The coil portions 310 and 320 are disposed on both surfaces of the support substrate 200, opposing each other, and exhibit characteristics of a coil component. For example, when the coil component 1000 according to this embodiment is used as a power inductor, the coil portions 310 and 320 may stabilize the power of an electronic device by storing an electric field as a magnetic field to maintain an output voltage.

Referring to FIGS. 2 and 4, each of the first coil portion 310 and the second coil portion 320 may have a flat spiral shape while forming at least one turn around a core portion 111 as an axis in the center thereof. As an example, the first coil portion 310 may form at least one turn around the core portion 111 on one surface of the support substrate 200.

The coil portions 310 and 320 may include a coil pattern having a flat spiral shape. The first and second coil portions 310 and 320, respectively disposed on both surface opposing each other in the support substrate 200, may be electrically connected to each other through a via electrode 900 formed in the support substrate 200.

The coil portions 310 and 320 and the via electrode 900 may include a metal having improved electrical conductivity and may be formed of, for example, silver (Ag), palladium (Pd), aluminum (Al), nickel (Ni), titanium (Ti), gold (Au), copper (Cu), platinum (Pt), or alloys thereof.

The lead-out portions 410 and 420 extend from the coil portions 310 and 320 to be exposed to the first and second surfaces 101 and 102 of the body 100, respectively. Referring to FIGS. 2 to 4, the first lead-out portion is formed by extending one end of the first coil portion 310 formed on end surface of the support substrate 200. The first lead-out portion 410 is exposed to the first surface 101 of the body 100. The second lead-out portion 420 is formed by extending one end of the second coil portion 320 formed on the other surface of the support substrate 200. The second lead-out portion 420 is exposed to the second surface 102 of the body 100.

The insulating layer 500 is disposed on the third surface 103 and the fourth surface 104 of the body 100. The insulating layer 500 includes an insulating resin 510 and a filler 520. As an example, an insulating layer 500 may be formed of an Ajinomoto Build-up Film (ABF) having a thickness lower than a thickness of the support substrate 200, but a material of the insulating layer 500 is not limited thereto.

As an example, the insulating resin 510 may be a thermosetting insulating resin such as an epoxy resin, a thermoplastic insulating resin such as polyimide, or a photosensitive insulating resin, but a material of the insulating resin 510 is not limited thereto.

As an example, the filler 520 may be one or more selected from the group consisting of silica ($SiO_2$), alumina ($Al_2O_3$), silicon carbide (SiC), barium sulphate ($BaSO_4$), talc, mud, mica powder, aluminum hydroxide ($AlOH_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$) and calcium zirconate ($CaZrO_3$), but is not limited thereto. In addition, the filler 520 may include an organic filler including a polymer material, but is not limited thereto.

In the insulating layer 500, a plurality of slits 530 are disposed to be spaced apart from each other to expose a portion of the surface of the body 100. Referring to FIGS. 1 to 3, the slit 530 is disposed to expose at least a portion of edges of the third surface 103 and the fourth surface 104 of the body. As an example, the slit 530 may be formed by performing an additional dicing process on the insulating layer 500 before performing a process of laminating the insulating layer 500 on the body 500 and dicing the insulating layer 500 into individual components. For example, the slit 530 may be formed in the insulating layer 500 by adjusting the dicing depth and performing a full-dicing process on a region in which the slit 530 is formed. As a result, the slits 530 are formed on an edge, at which the first surface 101 and the fourth surface 104 of the body 100 are in contact with each other, and an edge at which the second surface 102 and the fourth surface 104 are in contact with each other, respectively. In addition, the slits 530 are formed on an edge, at which the first surface 101 and the third surface 103 of the body 100 are in contact each other, and an edge at which the second surface 102 and the third surface 103 of the body 100 are in contact with each other, respectively. As a result, deformation, caused by a difference in coefficient of thermal expansion (CTE) between the insulating layer 500 and the body 100, may be prevented.

The oxide insulating layer 600 is formed on the first surface 101 and the second surface 102 of the body 100 and the fifth surface 105 and the sixth surface 106 of the body 100. Specifically, the oxide insulating layer 600 may be formed by oxidizing metal magnetic powder particles 110 and 120 exposed to the first surface 101, the second surface 102, the fifth surface 105, and the sixth surface 106 of the body 100. For example, when the metal magnetic powder particles 100 and 200 include iron (Fe), the oxide insulating layer 600 may be formed on the first surface 101, the second surface 102, the fifth surface 105, and the sixth surface 106 of the body 100 by acidizing the surface of the body 100 with an acid solution selectively reacting with only iron (Fe). As described above, since the body 100 includes the magnetic metal powder particles 110 and 120 and the resin, the magnetic metal powder particles 110 and 120 may be discontinuously exposed to the surface of the body 100. Accordingly, oxide insulating layers, formed on surfaces of the magnetic metal powder particles 110 and 120, may be discontinuously formed on the surface of the body 100. In this embodiment, after the dicing process is completed, the oxide insulating layer 600 is formed by reacting the surface of the body 100, on which the insulating layer 500 is laminated, with an acidic solution. As a result, the oxide insulating layer 600 may also be formed on an internal surface of the slit 530.

Since the oxide insulating layer 600 is formed by oxidizing the metal magnetic powder particles 110 and 120, the oxide insulating layer 600 may include a metal component of the metal magnetic powder particles 110 and 120. As an example, the oxide insulating layer 600 includes at least one selected from the group consisting of iron (Fe), niobium (Nb), silicon (Si), chromium (Cr), or alloys thereof.

The oxide insulating layer 600 is exposed to the surface of the body 100 as well as the magnetic metal powder particles 110 and 120, but may also be formed on the surfaces of the magnetic metal powder particles 110 and 120 disposed within a predetermined depth from the surface of the body 100. This is because the above-mentioned acid solution permeates the body 100 to a predetermined depth from the surface of the body 100 due to a relatively porous structure of the resin of the body 100. The predetermined depth from the surface of the body 100 may refer to 1.5 to 2 times the particle diameter of the first magnetic metal powder particles 110, but is not limited thereto.

Before the external electrodes 710 and 720 are formed by electroplating, the oxide insulating layer 600 may be selectively formed on the surface of the body 100 to be prevented from being plated in a region other than a region in which the external electrodes 710 and 720 are formed. In addition, after the plating process, electrical short-circuits may be prevented from occurring between the coil component 1000 of this embodiment and other electronic components.

Referring to FIG. 6, recesses 121 may be formed in the first surface 101, the second surface 102, the fifth surface 105, and the sixth surface 106 of the body 100. The recess 121 is formed because the second metal magnetic powder particles 120, exposed to the surface of the body 100, are completely removed during the above-described acidization of the surface of the body 100. Accordingly, the recess 121 has a diameter corresponding to the particle diameter of the second metal magnetic powder particle 120. As described above, since the acidic solution may permeate from the surface of the body 100 to the predetermined depth, the second metal magnetic powder particles 120, disposed within a predetermined depth from the surface of the body 100, may be removed by reacting with the acid solution. Accordingly, a vacancy corresponding to the particle diameter of the second magnetic metal powder particles 120 may be formed in a corresponding region.

In FIG. 6, the oxide insulating layer 600 is illustrated as being formed only on the surface of the first magnetic metal powder particle 110, but the scope of the present disclosure is not limited thereto. For example, the second metal magnetic powder particles 120 may be incompletely removed by reacting with the acid solution depending on a composition of the acid solution used for the above-mentioned acidization, acidization conditions, a composition of the resin and the second metal magnetic powder particles 120 of the body 100, and the like. In this case, the oxide insulating layer 600 may also be formed on the surfaces of the second magnetic metal powder particles 120.

Referring to FIGS. 1 and 2, the insulating layer 500 may be laminated on a surface of the body 100 parallel to the support substrate 200 to alleviate a decrease in a magnetic surface area resulting from the oxide insulating layer 600. As described above, since the oxide insulating layer 600 is formed by oxidizing the surfaces of the metal magnetic powder particles 110 and 120 exposed to the surface of the body 100, volumes of the magnetic metal powder particles 110 and 120 within the body 100 are decreased by the oxide insulating layer 600. Accordingly, component characteristics such as inductance are reduced. In this embodiment, after the insulating layer 500 is disposed on the third and fourth surfaces 103 and 104 of the body 100, the first, second, fifth, and sixth surfaces 101, 102, 105, and 106 may be acidized to relatively reduce the loss of the magnetic metal powder particles 110 and 120.

Table 1 shows rates of change in a surface area of a magnetic material, reduced by etching, when an Ajinomoto Build-up Film (ABF) was not disposed the surface of the body 100 and when an ABF was laminated on the third surface 103 and fourth surface 104 of the body 100. When the ABF was not disposed on the surface of the body 100, a surface area of an Etchable magnetic material was 8,960,000 $\mu m^2$. When four surfaces, on which the ABF was not disposed, were acidized, a surface area of an etched magnetic material was 4,160,000 $\mu m^2$. For example, when the ABF was laminated on two surfaces, the surface area of the magnetic material, reduced by the oxide insulating layer 600, was decreased by 46% as compared with the surface area when the ABF was not disposed.

TABLE 1

| | When ABF is not disposed on surface of body | When ABF is laminated on two surfaces of body | Rate of Change in Surface of Magnetic Material Decreased by Etching |
|---|---|---|---|
| Surface of Etchable Magnetic Material ($\mu m^2$) | 8,960,000 | 4,160,000 | 46% |

In addition, the present applicant measured rates of a decrease in inductance Ls when the ABF was not disposed on a surface of the body 100 and when the ABF is laminated and acidized on the third and fourth surfaces 103 and 104 of the body 100. When the ABF was not disposed on the surface of the body 100, a rate of a decrease in the inductance Ls was 3.3% on average. When acidization was performed on four surfaces on which the ABF was not laminated, a rate of a decrease in the inductance 2.0% on average. For example, when the ABF was laminated on two surfaces, the rate of a decrease in the inductance Ls, decreased by the oxide insulating layer 600, was improved by 62% as compared with the rate of a decrease when the ABF was not disposed.

The auxiliary lead-out portions 810 and 820 are disposed on the other surface and one surface of the support substrate 200 to correspond to the lead-out portions 410 and 420, respectively. Referring to FIGS. 1 and 2, a first lead-out portion 410 is disposed on one surface of the support substrate 200, and a first auxiliary lead-out portion 810 is disposed on the other surface of the support substrate 200. The second lead-out portion 420 is disposed on the other surface of the support substrate 200, and the second auxiliary lead-out portion 820 is disposed on one surface of the support substrate 200. As a result, the first auxiliary lead-out portion 810 is disposed to correspond to the first lead-out portion 410 on the basis of the support substrate 200, and the second auxiliary lead-out portion 820 is disposed to correspond to the second lead-out portion 420 on the basis of the support substrate 200. Referring to FIGS. 1 to 3, the auxiliary lead-out portions 810 and 820 are exposed to the surface of the body 100 together with the lead-out portions 410 and 420. In addition, the external electrodes 710 and 720 are formed not only on exposed surfaces of the lead-out portions 410 and 420 but also on exposed surfaces of the auxiliary lead-out portions 810 and 820. Accordingly, an area of a region, metallically bonded to the first and second external electrodes 710 and 720, of the surface of the body 100 may be increased to improve bonding force between the body 100 and the external electrodes 710 and 720.

At least one of the coil portions 310 and 320, the via electrode 900, the lead-out portions 410 and 420, and the auxiliary lead-out portions 810 and 820 may include at least one conductive layer.

As an example, when the first coil portion 310, the first lead-out portion 410, the first auxiliary lead-out portion 810, and the via electrode 900 may be formed on one surface side of the support substrate 200 by plating, each of the first coil portion 310, the first lead-out portion 410, the first auxiliary lead-out portion 810, and the via electrode 900 may include a seed layer such as an electroless plating layer and an electroplating layer. The electroplating layer may have a single-layer structure or a multilayer structure. The electroplating layer having a multilayer structure may be formed to have a conformal layer structure in which one electroplating layer is covered with another electroplating layer, and may be formed to have a structure in which one electroplating layer is laminated on only one surface of another electroplating layer. A seed layer of the first coil portions 310, a seed layer of the first lead-out portion 410, a seed layer of the first auxiliary lead-out portion 810, and a seed layer of the via electrode 900 may be integrally formed, such that boundaries therebetween may not be formed, but an embodiment thereof is not limited thereto. In the above-described example, an electroplating layers of the first coil portion 310, an electroplating layer of the first lead-out portion 410, electroplating layers of the first auxiliary lead-out portion 810, and an electroplating layer of the via electrode 900 are integrally formed, such that boundaries therebetween may not be formed, but an embodiment thereof is not limited thereto.

The coil portions 310 and 320, the lead-out portions 410 and 420, the auxiliary lead-out portions 810 and 820, and the via electrode 900 may be formed of a conductive material such as copper (Cu), aluminum (Al), silver (Ag), tin (Sn), gold (Au), nickel (Ni), lead (Pb), titanium (Ti), or alloys thereof, but a conductive material thereof is not limited thereto.

The external electrodes 710 and 720 are disposed on the surfaces of the body 100 to cover the lead-out portions 410 and 420.

Referring to FIGS. 1 and 2, since the first lead-out portion 410 is exposed to the first surface 101 of the body 100, the first external electrode 710 may be formed on the first surface 101 of the body 100 to be connected to the first lead-out portion 410. The second external electrode 720 may be formed on the second surface 102 of the body 100 to be connected to the second lead-out portion 420 exposed to the second surface 102 of the body 100.

Each of the first external electrode 710 and the second external electrode 720 extends to the third surface 103 and the fourth surface 104 of the body 100, such that at least a portion of each of the external electrodes 710 and 720 is disposed on the insulating layer 500. As will be described later, the external electrodes 710 and 720 include a conductive resin layer formed by applying and curing a conductive paste including conductive powder particles such as silver (Ag), or the like, and a conductive resin layer. Such a conductive resin layer extends to the third surface 103 and the fourth surface 104 to be disposed on the insulating layer 500.

The external electrodes 710 and 720 may have a single-layer structure or a multilayer structure. Referring to FIGS. 3 and 4, the external electrodes 710 and 720 may include a first layer 711, covering the lead-out portions 410 and 420, and a second layer 712 disposed on the first layer 711. In this embodiment, the first layer 711 may include a conductive resin layer, and the second layer 712 may include a metal layer. As a result, the conductive resin layer of the external electrodes 710 and 720 may fill the slit 530 exposed to one region of the surface of the body 100, as illustrated in FIG. 3.

The conductive resin layer may include any one or more conductive metals, selected from the group consisting of copper (Cu), nickel (Ni), and silver (Ag), and a thermosetting resin. The thermosetting resin, included in the conductive resin layer, and the thermosetting resin, included in the body 100, may be the same thermosetting resin. For example, the body 100 and the conductive resin layer may include an epoxy resin. The thermosetting resins, included in the body 100 and the conductive resin layer, may be formed of the same thermosetting resin, for example, an epoxy resin, to improve adhesion strength between the body 100 and the external electrodes 710 and 720.

Modified Version of First Embodiment

Figure 7:
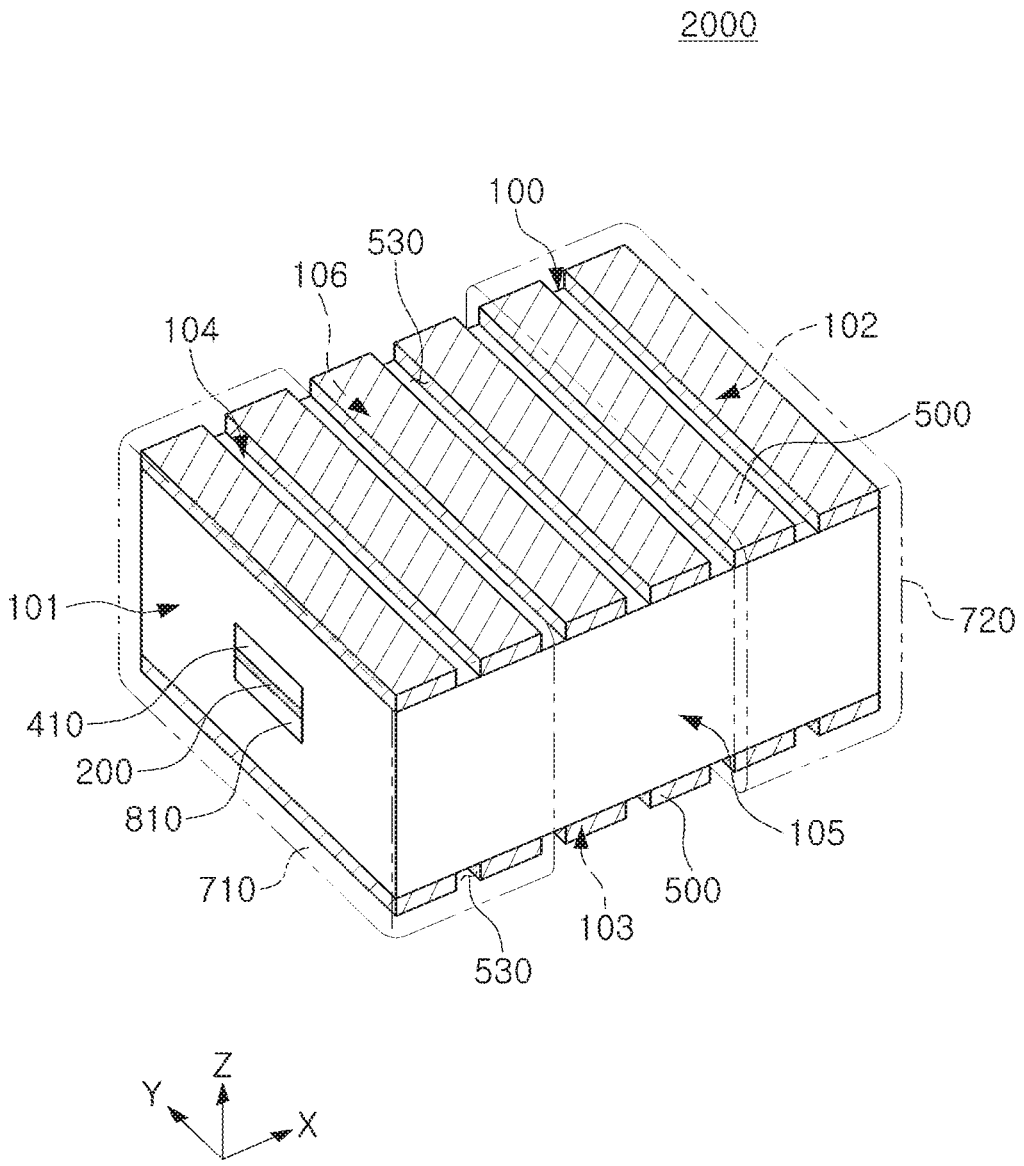
FIGS. 7 and 8 are schematic diagrams, each illustrating a coil component according to a modified version of the first embodiment in the present disclosure.
Figure 8:
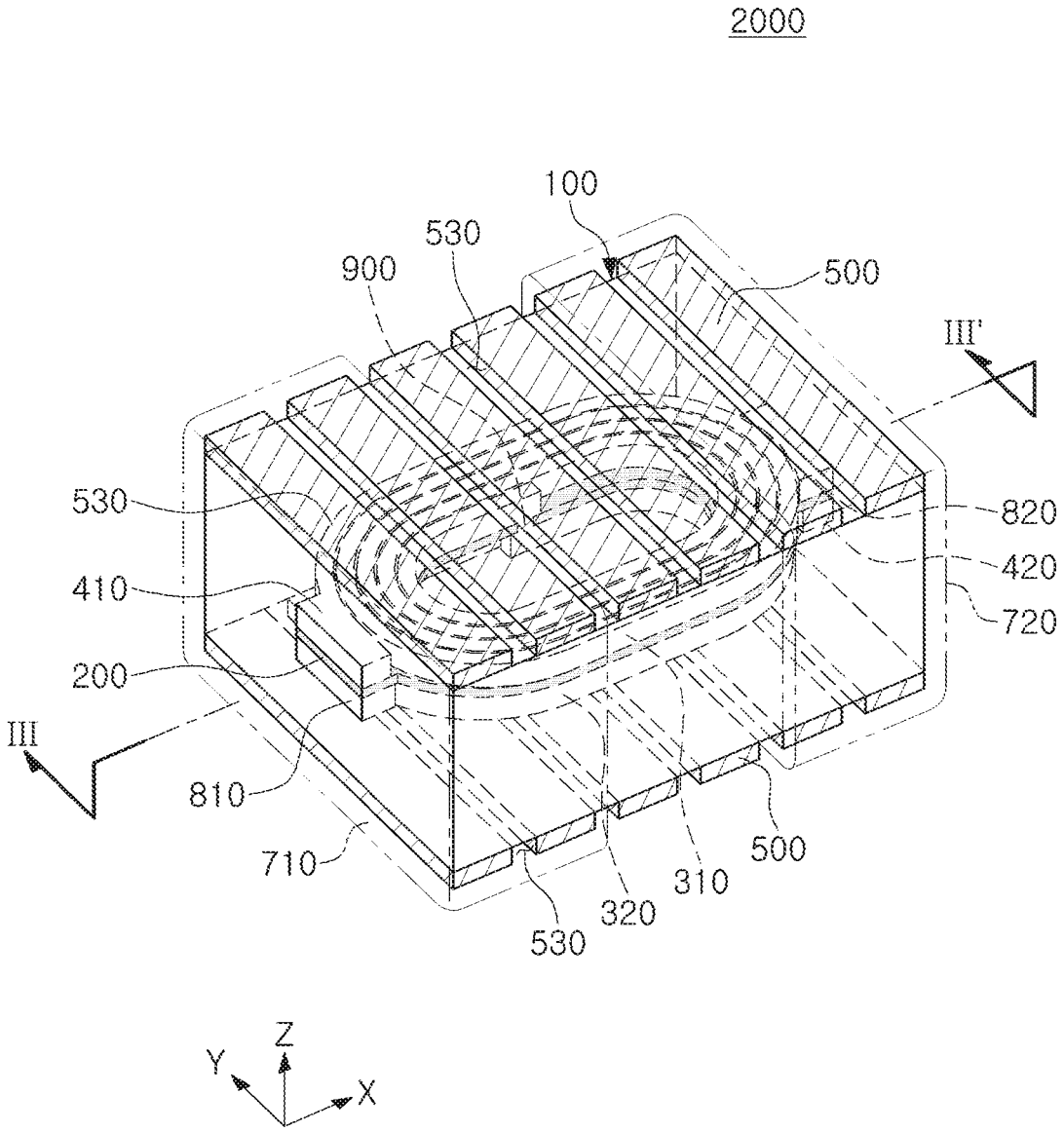
Figure 9:
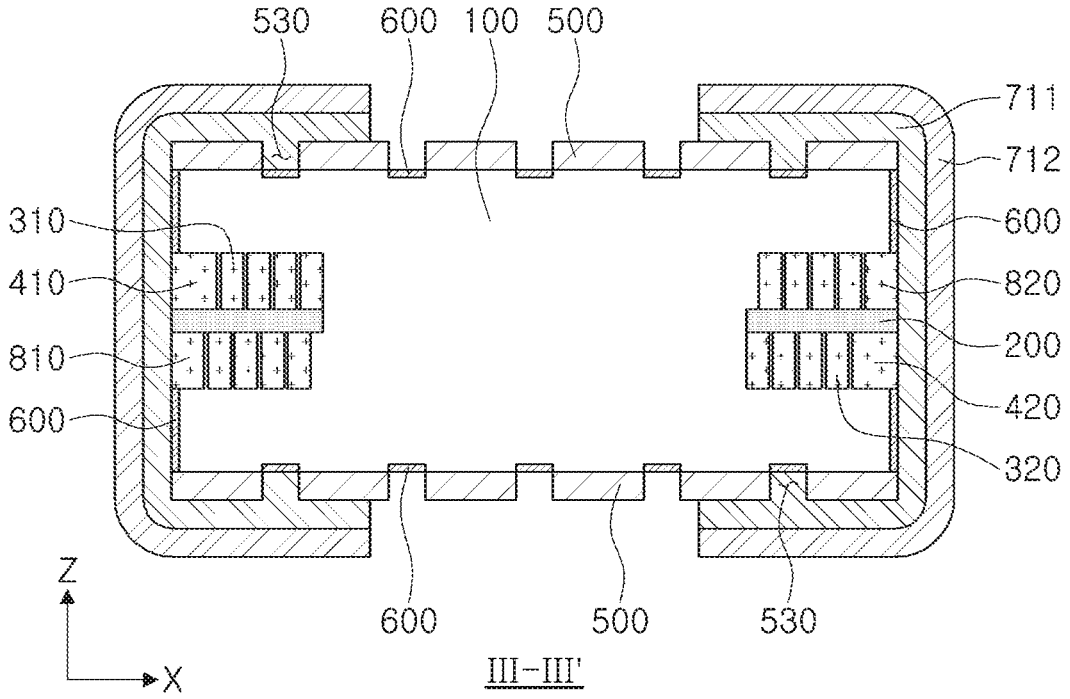
FIG. 9 is a cross-sectional view taken along line III-III' in FIG. 8.

FIGS. 7 and 8 are schematic diagrams, each illustrating a coil component according to a modified version of the first embodiment, and FIG. 9 is a cross-sectional view taken along line III-III' in FIG. 8. A body, applied to the coil component according to a modified version of the first embodiment, is mainly illustrated in FIG. 7. A coil portion, applied to the coil component according to a modified version of the first embodiment, is mainly illustrated in FIG. 8.

A coil component 2000 according to this modified version is different in a distance between slits 530, spaced apart from each other, and the number of the slits 530, as compared with the coil component 1000 according to the first embodiment. Therefore, only the distance of the slits 530 and the number of the slits 530, different from those of the first embodiment, will be described. The descriptions of the first embodiment may be applied to the rest of the configuration of this modified version as it is.

Referring to FIGS. 7 and 8, a distance between a plurality of slits 530, spaced apart from each other, of this modified version is shorter than a distance between the slits 530, spaced apart from each other, of the first embodiment. A structure of the slit 530 of this modified version is formed by reducing a width of a dicing blade to be narrower than in the first embodiment during an additional dicing process on the insulating layer 500. As a result, the slit 530 is more densely formed on the third surface 103 and the fourth surface 104 of the body 100. A larger number of slits may be formed in the insulating layer 500 to more effectively prevent deformation caused by a difference in thermal expansion coefficients (CTE) between the insulating layer 500 and the body 100.

Second Embodiment

Figure 10:
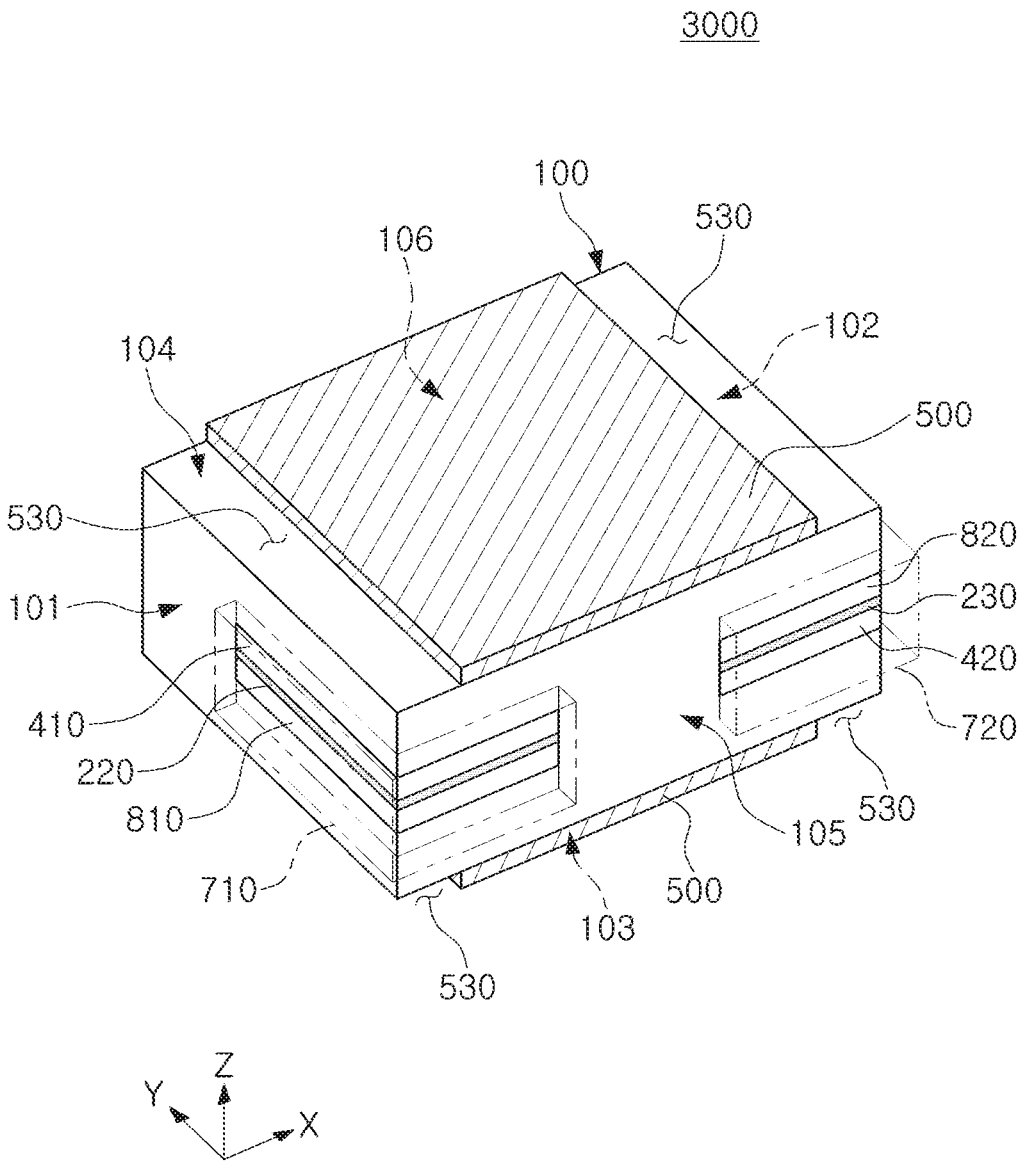
FIGS. 10 and 11 are schematic diagrams, each illustrating a coil component according to a second embodiment in the present disclosure.
Figure 11:
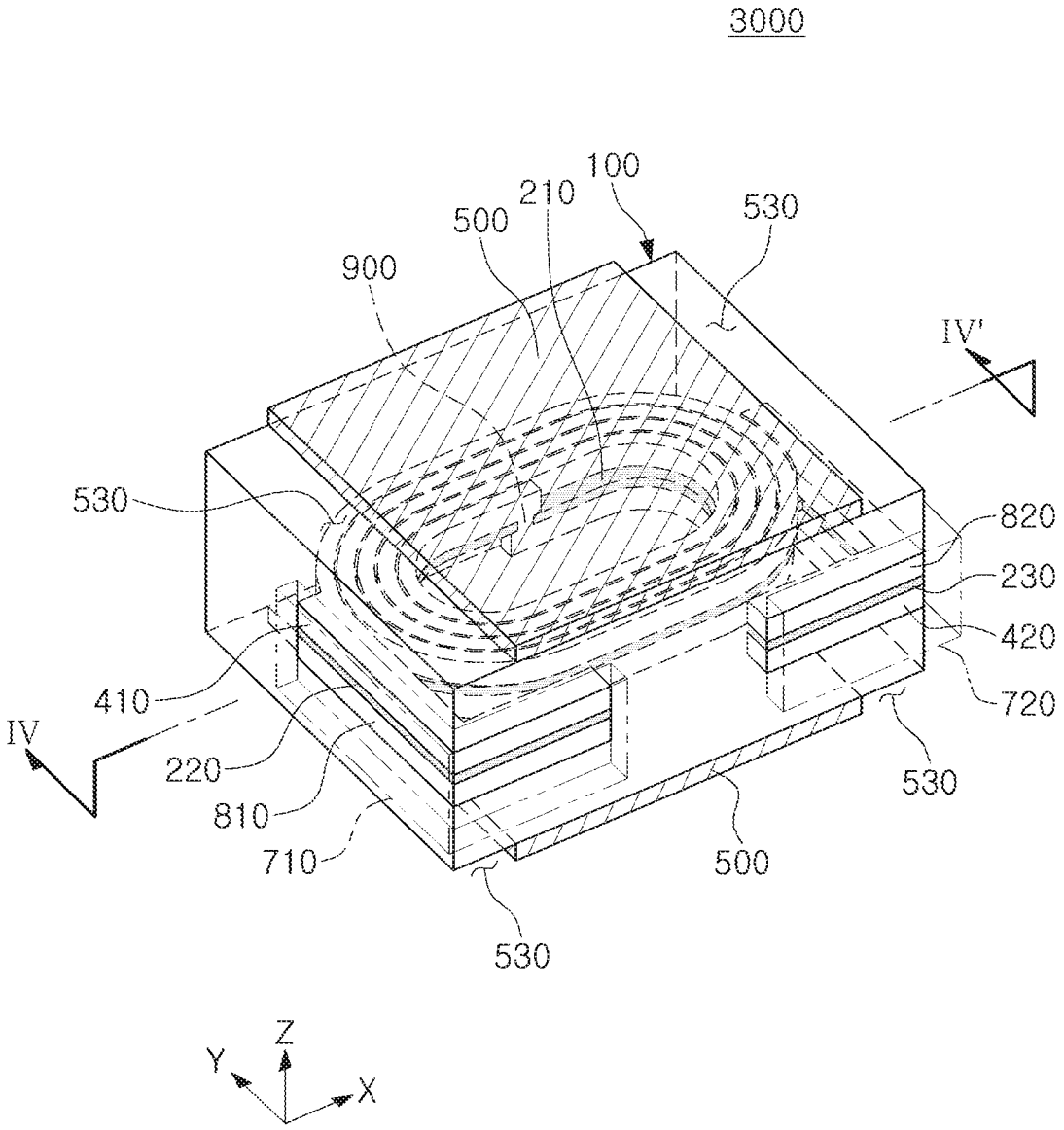
Figure 12:
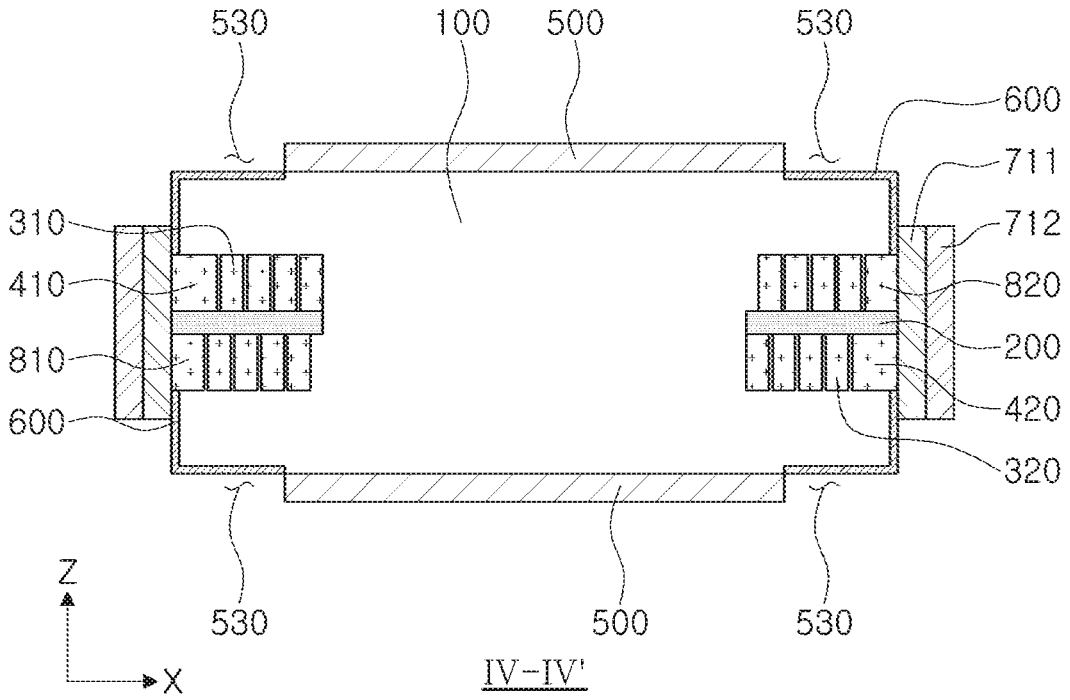
FIG. 12 is a cross-sectional view, taken along line IV-IV' in FIG. 11, of the coil component illustrated in FIG. 11.

FIGS. 10 and 11 are schematic diagrams, each illustrating a coil component according to a second embodiment in the present disclosure, and FIG. 12 is a cross-sectional view, taken along line IV-IV' in FIG. 11, of the coil component illustrated in FIG. 11. A body, applied to the coil component according to the second embodiment, is mainly illustrated in FIG. 10. A coil portion, applied to the coil component according to the second embodiment, is mainly illustrated in FIG. 11.

A coil component 3000 according to this embodiment is different in shapes and arrangements of a support substrate 200, lead-out portion 410 and 420, external electrodes 710 and 720, as compared with the coil component 1000 according to the first embodiment. Therefore, only the shapes and arrangements of the support substrate 200, the lead-out portion 410 and 420, the external electrodes 710 and 720, different from those of the first embodiment, will be described. The descriptions of the first embodiment may be applied to the rest of the configuration of this embodiment as it is.

In this embodiment, the body 100 has a first surface 101 and the second surface 102, opposing each other, and a third surface 103 and a fourth surface 104 opposing each other while connecting the first surface 101 and the second surface 102.

Referring to FIGS. 10 and 11, a support substrate 200 includes a support portion 210, supporting coil portions 310 and 320, and end portions 220 and 230 supporting the lead-out portions 410 and 420.

The support portion 210 is one region, disposed between the first and second coil portions 310 and 320, of the support substrate 200 to support the coil portions 310 and 320.

The end portions 220 and 230 extend from the support portion 210. The end portions 220 and 230 are one regions of the support substrate 200 supporting the lead-out portions 410 and 420 and the auxiliary lead-out portions 810 and 820. Specifically, a first end portion 220 is disposed between the first lead-out portion 410 and the first auxiliary lead-out portion 810 to support the first lead-out portion 410 and the first auxiliary lead-out portion 810. The second end portion 230 is disposed between the second lead-out portion 420 and the second auxiliary lead-out portion 820 to support the second lead-out portion 420 and the second auxiliary lead-out portion 820.

Referring to FIGS. 10 and 11, the end portions 220 and 230 may include the first end portion 220, exposed to the first surface 101 and the fifth surface 105 of the body 100, and the second end portion 230 exposed to the second surface 102 and the fifth surface 105 of the body 100.

Referring to FIGS. 10 and 11, the lead-out portions 410 and 420 include a first lead-out portion 410, connected to one end portion of the first coil portion 310 and exposed to the first surface 101 and the fifth surface 105 of the body 100, and a second lead-out portion 420 connected to one end portion of the second coil portion 320 and exposed to the second surface 102 and the fifth surface 105 of the body 100. For example, in this embodiment, the lead-out portions 410 and 420 are exposed on a surface of the body 100 in an L shape.

Accordingly, as compared with the first embodiment, an area, in which the lead-out portions 410 and 420 are disposed inside the body 100, may be increased to further increase electrical connectivity to the external electrodes 710 and 720. As a result, connection reliability with the external electrodes 710 and 720 may be improved even without increasing a size of the coil component 3000.

Referring to FIGS. 10 and 11, the first external electrode 710 may cover the first lead-out portion 410 and may be disposed on the first surface 101 and the fifth surface 105 of the body 100, but is not disposed on the third surface 103, the fourth surface 104, and the sixth surface 106 of the body 100. The second external electrode 720 may cover the second lead-out portion 420 and may be disposed on the second surface 102 and the fifth surface 105 of the body 100, but is not disposed on the third surface 103, the fourth surface 104, and the sixth surface 106 of the body 100.

The first and second external electrodes 710 and 720 may have a width narrower than a width of the body 100. As the external electrode 710 is disposed on portions of the first surface 101 and the fifth surface 105 of the body 100 and the external electrode 720 is disposed on portions of the second surface 102 and the fifth surface 105 of the body 100 and each of the external electrodes 710 and 720 has a width narrower than the width of the body 100, an influence of the external electrodes 710 and 720, impeding a flow of magnetic flux, may be reduced to improve inductor performance such as inductance L and quality factor Q.

Referring to FIG. 12, the external electrodes 710 and 720 may include a first metal layer 711, covering the lead-out portions 410 and 420, and a second metal layer 712 disposed on the first metal layer 711. The first metal layer 711 includes a metal layer, including a conductive material such as copper (Cu), and the second metal layer 712 includes a metal layer including nickel (Ni) and tin (Sn).

Modified Version of Second Embodiment

Figure 13:
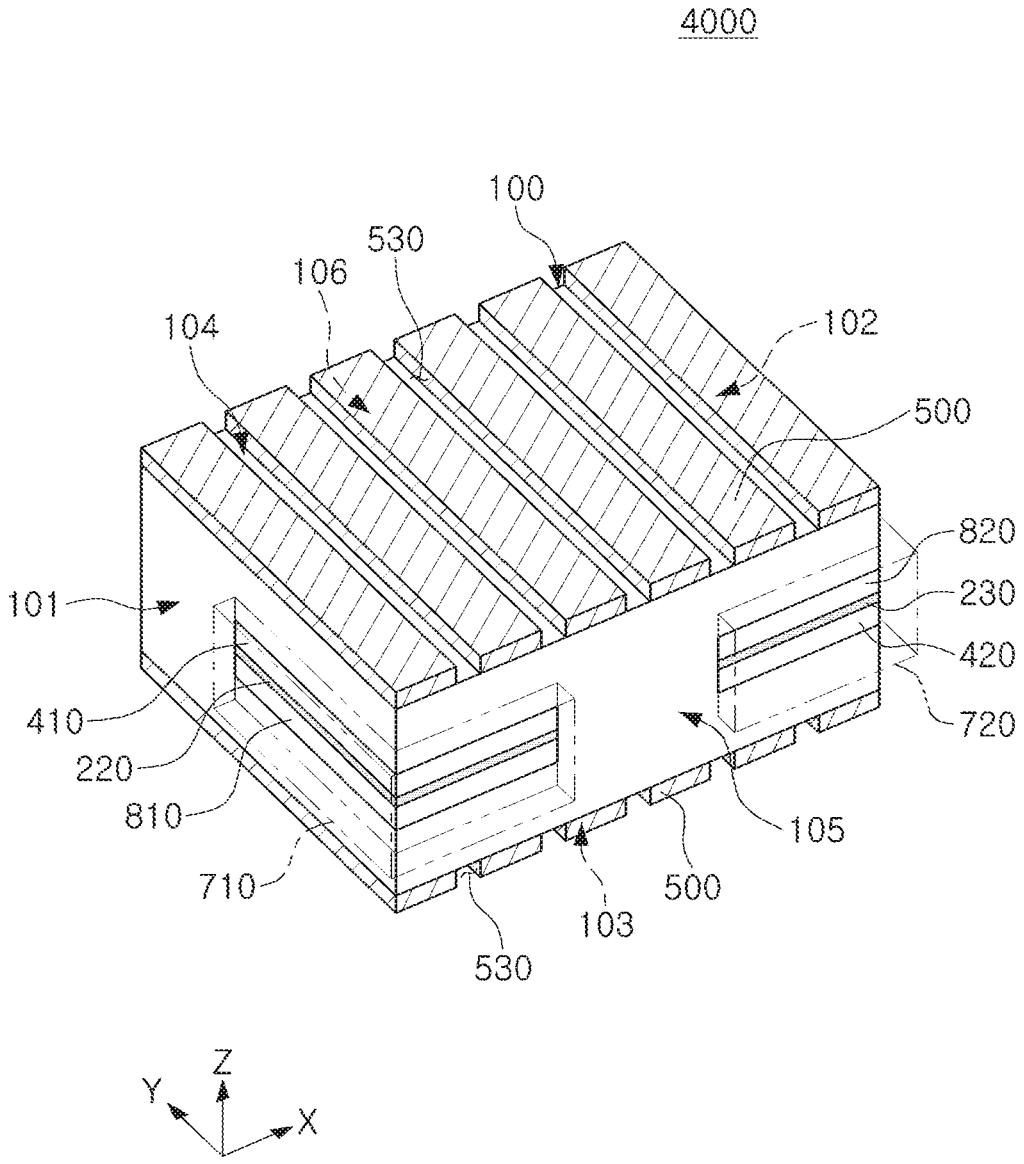
FIGS. 13 and 14 are schematic diagrams, each illustrating a coil component according to a modified version of the second embodiment in the present disclosure.
Figure 14:
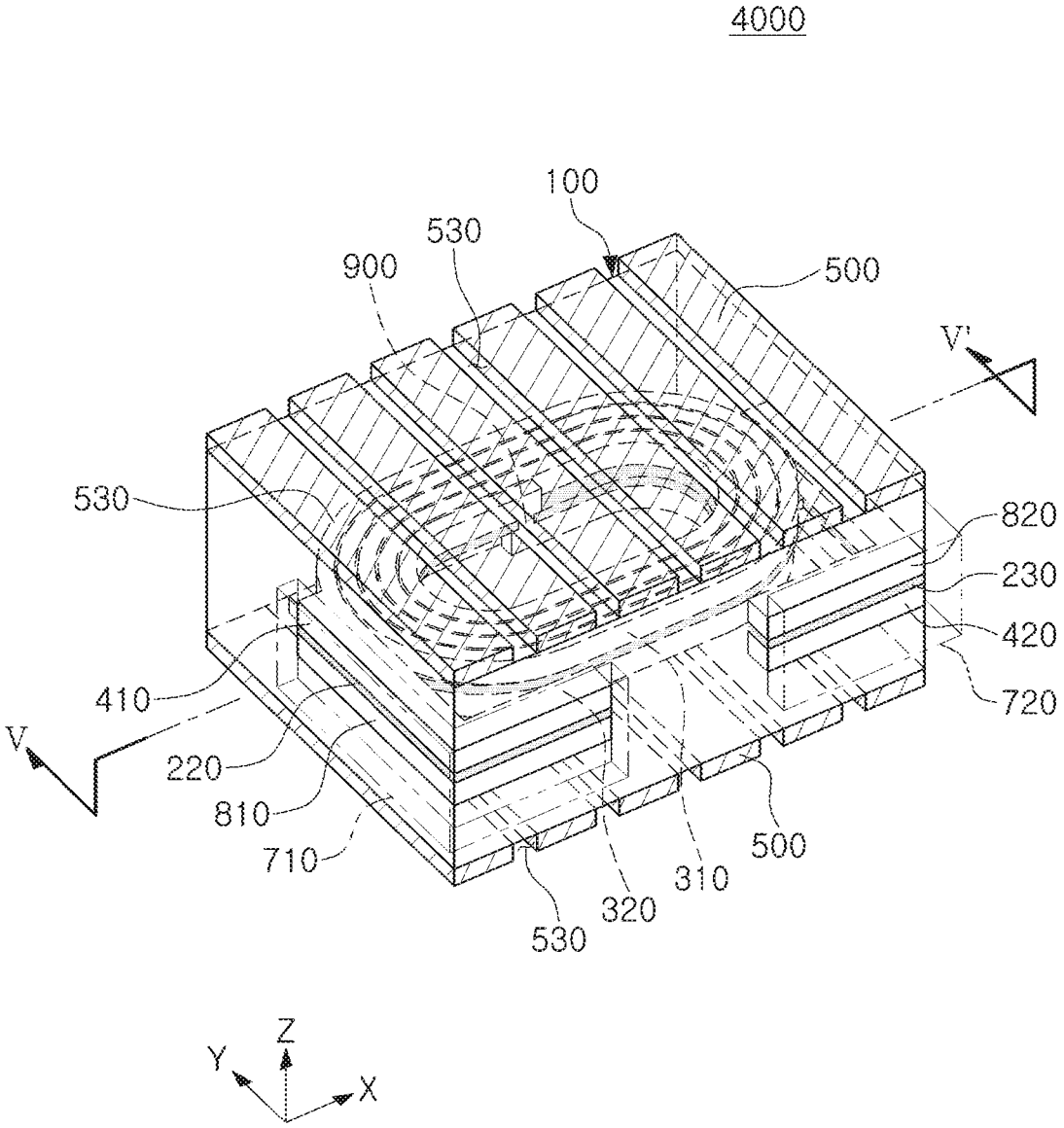
Figure 15:
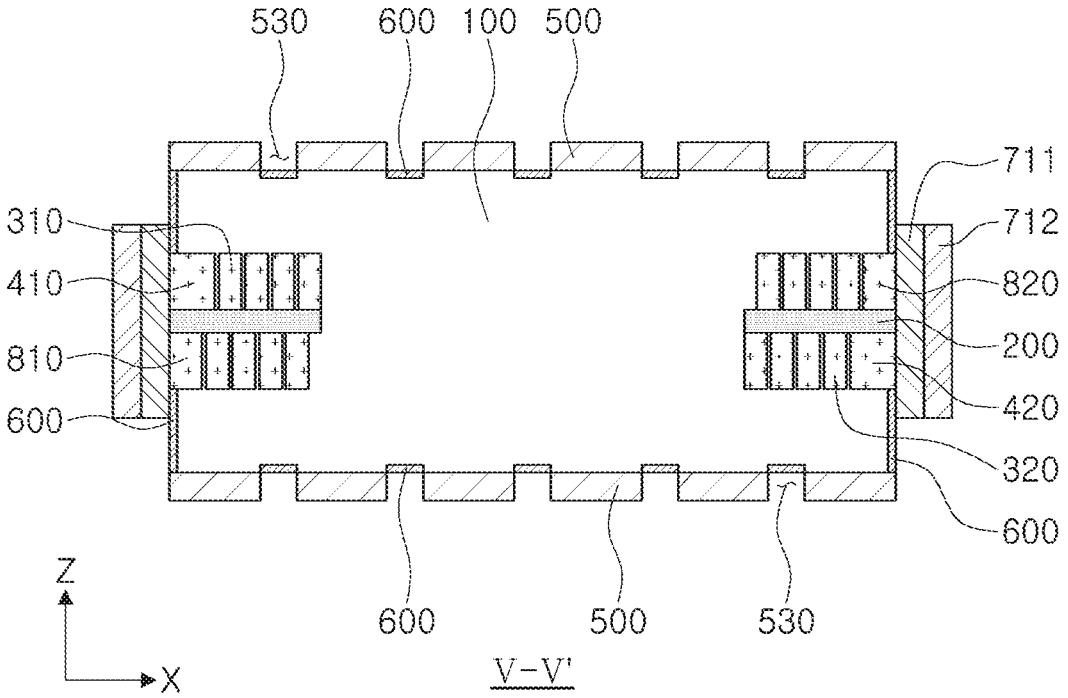
FIG. 15 is a cross-sectional view taken along line V-V' in FIG. 14.

FIGS. 13 and 14 are schematic diagrams, each illustrating a coil component according to a modified version of the second embodiment in the present disclosure, and FIG. 15 is a cross-sectional view taken along line V-V' in FIG. 14.

A coil component 4000 according to this modified version is different in a distance between slits 530, spaced apart from each other, and the number of the slits 530, as compared with the coil component 3000 according to the second embodiment. Therefore, only the distance of the slits 530 and the number of the slits 530, different from those of the second embodiment, will be described. The descriptions of the second embodiment may be applied to the rest of the configuration of this modified version as it is.

Referring to FIGS. 13 and 14, a distance between a plurality of slits 530, spaced apart from each other, of this modified version is shorter than a distance between the slits 530, spaced apart from each other, of the second embodiment. A structure of the slit 530 of this modified version is formed by reducing a width of a dicing blade to be narrower than in the second embodiment during an additional dicing process on the insulating layer 500. As a result, the slit 530 is more densely formed on the third surface 103 and the fourth surface 104 of the body 100. A larger number of slits may be formed in the insulating layer 500 to more effectively prevent deformation caused by a difference in thermal expansion coefficients (CTE) between the insulating layer 500 and the body 100.

As described above, according to the present disclosure, plating bleeding of an external electrode may be prevented to improve reliability of a coil component.

In addition, a decrease in a surface area of a magnetic material of a body may be effectively prevented.

While example embodiments have been shown and described above, it will be apparent to those skilled in the art that modifications and variations could be made without departing from the scope of the present disclosure as defined by the appended claims.

What is claimed is:

1. A coil component comprising:

a support substrate and a coil portion disposed on the support substrate;

a body, in which the support substrate and the coil portion are embedded, having one surface and the other surface opposing each other in a first direction, one side surface and the other side surface connecting the one surface and the other surface to each other and opposing each other in a second direction, and one end surface and the other end surface, opposing each other, each connecting the one side surface and the other side surface to each other;

a first lead-out portion extending from the coil portion to the one side surface of the body;

a second lead-out portion extending from the coil portion to the other side surface of the body;

an insulating layer disposed on one of the one surface and the other surface of the body;

an oxide insulating layer disposed on each of the one side surface and the other side surface of the body and each of the one end surface and the other end surface of the body;

a first external electrode disposed on the one side surface of the body to cover the first lead-out portion, and extending to the one of the one surface and the other surface of the body such that at least a portion of the first external electrode covers the insulating layer to overlap a portion of the insulating layer in the first direction; and a second external electrode disposed on the other side surface of the body to cover the second lead-out portion, and extending to the one of the one surface and the other surface of the body such that at least a portion of the second external electrode covers the insulating layer to overlap another portion of the insulating layer in the first direction, wherein the insulating layer is provided with a plurality of slits spaced apart from each other, the oxide insulating layer is provided as bottom surfaces of the slits, and portions of the oxide insulating layer and one or more portions of the insulating layer, disposed on one of the one surface and the other surface of the body, are alternately disposed in the second direction.

2. The coil component of claim 1, wherein the insulating layer comprises an insulating resin and a filler.

3. The coil component of claim 1, wherein the oxide insulating layer comprises at least one selected from the group consisting of iron (Fe), niobium (Nb), silicon (Si), chromium (Cr), and alloys thereof.

4. The coil component of claim 3, wherein the body comprises first metal magnetic powder particles and second metal magnetic powder particles each having a particle diameter smaller than a particle diameter of each of the first metal magnetic powder particles, and the oxide insulating layer is disposed on a surface of each of the first metal magnetic powder particles exposed from the one side surface, the other side surface, the one end surface, and the other end surface of the body.

5. The coil component of claim 4, wherein the oxide insulating layer is discontinuously disposed on the one side surface, the other side surface, the one end surface, and the other end surface of the body of the body.

6. The coil component of claim 4, wherein a recess, having a diameter corresponding to the particle diameter of each of the second metal magnetic powder particles, is disposed in the one side surface, the other side surface, the one end surface, and the other end surface of the body.

7. The coil component of claim 1, wherein each of the first and second external electrodes comprises a conductive resin layer and a metal layer disposed on the conductive resin layer.

8. The coil component of claim 7, wherein the first and second external electrodes fill one or more of the plurality of slits.

9. The coil component of claim 1, wherein the first and second lead-out portions are disposed on one surface and the other surface of the support substrate, respectively, the coil component further comprises a first auxiliary lead-out portion, disposed on the other surface of the support substrate, and a second auxiliary lead-out portion disposed on the one surface of the support substrate, and the first and second auxiliary lead-out portions are disposed to correspond to the first and second lead-out portions, respectively.

10. A coil component comprising:

a body having a first surface and a second surface opposing each other, a third surface and a fourth surface, opposing each other, each connecting the first surface and the second surface to each other, and a fifth surface and a sixth surface, opposing each other, each connecting the first surface and the second surface to each other;

a support substrate disposed inside body;

a first coil portion and a second coil portion, respectively disposed on opposite surfaces of the support substrate;

a first lead-out portion connected to one end portion of the first coil portion and extending from one of the first surface and the fifth surface of the body;

a second lead-out portion connected to one end portion of the second coil portion and extending from one of the second surface and the fifth surface of the body;

an insulating layer disposed on one of the third and fourth surfaces of the body, the insulating layer comprising an insulating resin; and an oxide insulating layer disposed on one or more of the first, second, fifth, and sixth surfaces of the body, wherein the insulating layer is provided with three or more slits spaced apart from each other on the one of the third and fourth surfaces of the body to expose three or more portions of the one of the third and fourth surfaces of the body.

11. The coil component of claim 10, wherein the support substrate comprises a support portion supporting the first and second coil portions, a first end portion extending from the one of the first and fifth surfaces of the body while supporting the first lead-out portion, and a second end portion extending from the one of the second and fifth surfaces of the body while supporting the second lead-out portion.

12. The coil component of claim 10, further comprising:

a first external electrode disposed on the one of the first and fifth surfaces of the body to cover the first lead-out portion; and a second external electrode disposed on the one of the second and fifth surfaces of the body to cover the second lead-out portion, wherein each of the first and second external electrodes comprises a first metal layer and a second metal layer disposed on the first metal layer.

13. A coil component comprising:

a support substrate and a coil portion disposed on the support substrate;

a body, in which the support substrate and the coil portion are embedded, having one surface and the other surface opposing each other, one side surface and the other side surface connecting the one surface and the other surface to each other and opposing each other, and one end surface and the other end surface, opposing each other, each connecting the one side surface and the other side surface to each other;

a first lead-out portion extending from the coil portion to the one side surface of the body;

a second lead-out portion extending from the coil portion to the other side surface of the body;

an insulating layer provided with a plurality of slits spaced apart from each other, the insulating layer disposed on only the one surface and the other surface of the body, among the one surface, the other surface, the one side surface, the other side surface, the one end surface, and the other end surface;

an oxide insulating layer disposed on each of the one side surface and the other side surface of the body and each of the one end surface and the other end surface of the body;

a first external electrode disposed on the one side surface of the body to cover the first lead-out portion, and extending to cover portions of the insulating layer; and a second external electrode disposed on the other side surface of the body to cover the second lead-out portion, and extending to cover portions of the insulating layer.

14. The coil component of claim 13, wherein the insulating layer comprises an insulating resin and a filler.

15. The coil component of claim 13, wherein the oxide insulating layer comprises at least one selected from the group consisting of iron (Fe), niobium (Nb), silicon (Si), chromium (Cr), and alloys thereof.

16. The coil component of claim 15, wherein the body comprises first metal magnetic powder particles and second metal magnetic powder particles each having a particle diameter smaller than a particle diameter of each of the first metal magnetic powder particles, and the oxide insulating layer is disposed on a surface of each of the first metal magnetic powder particles exposed from the one side surface, the other side surface, the one end surface, and the other end surface of the body.

17. The coil component of claim 16, wherein the oxide insulating layer is discontinuously disposed on the one side surface, the other side surface, the one end surface, and the other end surface of the body of the body.

18. The coil component of claim 16, wherein a recess, having a diameter corresponding to the particle diameter of each of the second metal magnetic powder particles, is disposed in the one side surface, the other side surface, the one end surface, and the other end surface of the body.

* * * * *